United States Patent [19]

Lindberg

[11] Patent Number: 4,961,367

[45] Date of Patent: Oct. 9, 1990

[54] ARRANGEMENT IN AN AMMUNITION FEEDING PATH TANKS

[75] Inventor: Sven Lindberg, Degerfors, Sweden

[73] Assignee: Aktiebolaget Bofors, Bofors, Sweden

[21] Appl. No.: 420,431

[22] Filed: Oct. 12, 1989

[30] Foreign Application Priority Data

Oct. 12, 1988 [SE] Sweden ..... 8803616

[51] Int. Cl.[5] ..... F41A 9/37

[52] U.S. Cl. ..... 89/33.04; 89/46

[58] Field of Search ..... 89/45, 46, 47, 33.01, 89/33.04, 36.08

[56] References Cited

U.S. PATENT DOCUMENTS

| | | | |
|---|---|---|---|
| 397,310 | 2/1889 | Schneider | 89/45 |
| 2,891,448 | 6/1959 | Hengstrom et al. | 89/45 |
| 3,608,424 | 9/1971 | Wiese | 89/45 |
| 4,127,055 | 11/1978 | Hottinger et al. | 89/45 |
| 4,438,677 | 3/1984 | Spotzl et al. | 89/47 |
| 4,448,107 | 5/1984 | Kotai et al. | 89/45 |
| 4,612,843 | 9/1986 | Marcon et al. | 89/33.04 |

FOREIGN PATENT DOCUMENTS

| | | | |
|---|---|---|---|
| 660930 | 9/1930 | France | 89/46 |
| 798231 | 5/1936 | France | 89/46 |
| 17595 | of 1913 | United Kingdom | 89/46 |

*Primary Examiner*—Charles T. Jordan
*Assistant Examiner*—Stephen Johnson
*Attorney, Agent, or Firm*—Pollock, Vande Sande & Priddy

[57] ABSTRACT

A tank features magazines which hold ammunition units (*3a, 3b*) of different types. The feeding path includes discharge devices for discharging the ammunition units from the magazines, and a turntable (8) for receiving each respective ammunition unit discharged from the magazines and turning the ammunition unit to a traverse direction which coincides with a preset traverse direction for the gun of the tank. There are further included means for transferring each respective ammunition unit from the turntable to the ramming position in the gun. The turntable is provided with two carrier units (*8a, 8b*) for ammunition units. The carrier units are alternatingly movable into and out of the feeding path for the ammunition units. On feeding of the first type of ammunition unit (*3a*), the first unit operates in the feeding path, while the second unit is located outside the feeding path where it carries an ammunition unit (*3b*) of the second type. On switching from the one ammunition type to the other, the turntable is disposed to move the first carrier unit out of the feeding path and the second carrier unit into the feeding path.

9 Claims, 1 Drawing Sheet

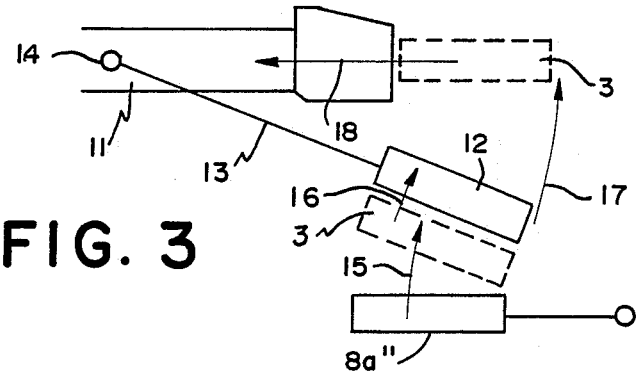
FIG. 3
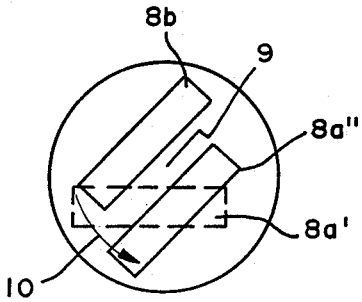
FIG. 2
FIG. 4
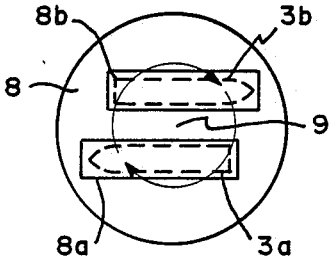
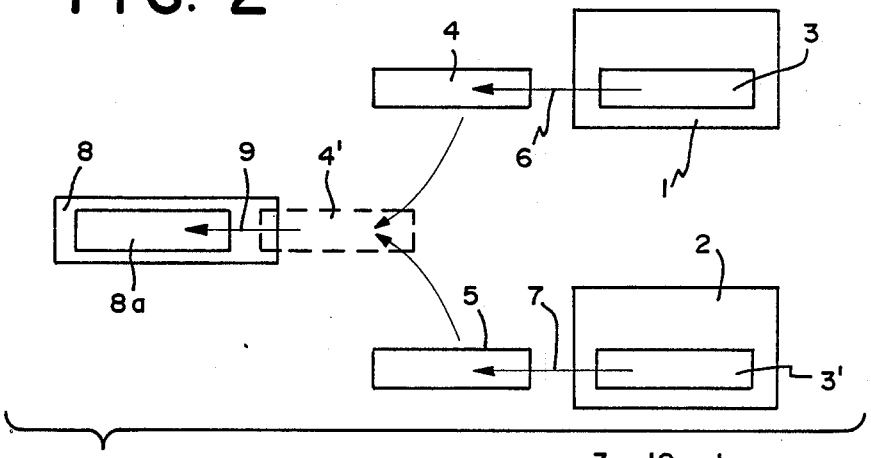
FIG. 1
FIG. 5
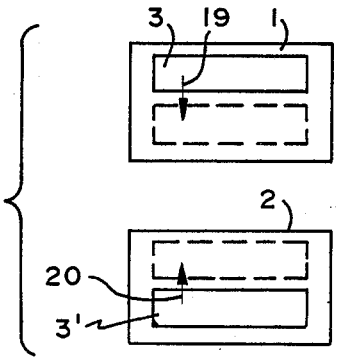

ARRANGEMENT IN AN AMMUNITION FEEDING PATH TANKS

BACKGROUND OF THE INVENTION

The present invention relates to an arrangement in an ammunition feeding path for ammunition units in a tank, comprising magazines with two types of ammunition, discharge devices for discharging the ammunition units from the magazine or magazines, a turntable for receiving each respective ammunition unit fed from the magazine or magazines and turning each respective ammunition unit to a traverse direction which corresponds to a preset traverse direction of the gun of the tank, and transfer devices which, in this preset traverse direction, transfer each respective ammunition unit from the turntable to a ramming position in the gun.

A number of feeding principles for ammunition units are previously known in the gunnery art in conjunction with tanks and armored combat vehicles. Thus, it is previously known to retrieve ammunition units or rounds from the magazines in or outside the tank and insert these into a turntable at the bottom of the tank, the ammunition units being swung by means of the turntable to the pertinent traverse direction, whereafter the round can be transferred from the turntable to the ramming position.

It is also previously known to have different types of ammunition units in the magazines and to fire different types of ammunition using the same gun. Switching from one ammunition unit type to another must then take place in the feeding path.

SUMMARY OF THE INVENTION

In prior-art feeding arrangements, it has hitherto been necessary first to fire or move aside inside the tank an ammunition unit or ammunition units of the first type partially advanced along the feeding path before it becomes possible to switch to the second ammunition type.

It is a technical problem to accomplish rapid transition from one ammunition type to another in connection with firing from a gun on a tank, where the space available for ammunition feeding is, as a rule, limited to the extreme.

The primary object of the present invention is to provide an arrangement which obviates this and other problems of the prior art. According to the novel features of the present invention is that the turntable for discharged ammunition units is provided with two carrier units which may alternatingly be inserted in and withdrawn from the feeding path. Further characterizing features are that, on feeding of the first type of ammunition unit, the first carrier unit operates in the feeding path and the second carrier unit is located outside the feeding path where it carries an ammunition unit of the second type. Finally, the present invention is characterized in that, on switching from feeding of ammunition units of the first type to the second type, the turntable is disposed to move the first carrier unit out of and the second carrier unit into the feeding path.

In further embodiments of the present invention the carrier units is disposed on the same plane on the turntable and on opposites sides of a rotation center of the turntable. Furthermore, the carrier units may be disposed to be mutually parallel and slightly longitudinally offset in relation to one another. Preferably, switching of carrier unit in the feeding path is effected by turning the turntable through 180° in its turning plane, the carrier unit charged with the second ammunition type replacing the ammunition unit of the first type already partially advanced in the first carrier unit. The carrier units carry their respective ammunition units so that these lie in opposite directions to one another.

By employing the arrangement proposed in the foregoing, a rapid switch of ammunition unit type may be obtained. The partially advanced unit of the first type is moved aside from the feeding path, while the second carrier unit, which, as a preparatory measure, is loaded with an ammunition unit of the second type, is moved into the feeding path. Correspondingly, the first carrier unit which was displaced will be prepared for feeding of the first ammunition type when return to this first ammunition type is to take place, and so on. The switch of the ammunition unit type may take place substantially without delay and without the need for first removing from the feeding path or firing from the gun a round being already partially advanced.

BRIEF DESCRIPTION OF THE ACCOMPANYING DRAWINGS

The nature of the present invention and its aspects will be more readily understood from the following brief description of the accompanying Drawings, and discussion relating thereto of one currently proposed embodiment of an arrangement displaying the characteristics significative of the present invention.

In the accompanying Drawings:

FIG. 1 schematically illustrates discharge from the magazine of ammunition units to a turntable, the transfer from the magazine to the turntable optionally being effected via a pivotal cradle;

FIG. 2 is a plan view schematically illustrating the work of the turntable in the feeding path;

FIG. 3 is a side elevation schematically illustrating the transfer of an ammunition unit inserted in the turntable to the ramming position with the aid of a loading pendulum;

FIG. 4 is a plan view schematically illustrating the function of the turntable, where the two carrier units of the turntable may alternatingly be moved into the feeding path; and FIG. 5 is a plan view schematically illustrating transverse feeding movements for ammunition units in the magazines.

DESCRIPTION OF DETAILED EMBODIMENT

Referring to the Drawings, in FIG.1, two magazines, of a tank are represented by reference numeral 1 indicating the left-hand magazine and reference numeral 2 indication the right-hand magazine. Ammunition units 3 and 3' respectively are each longitudinally displaceable out of the magazine to a respective cradle 4, 5. Discharge is effected in the direction of the arrows 6 and 7. Each cradle 4 and 5 is pivotal to a position at a turntable 8 which is shown from the side. The figure shows pivoting of the cradle 4 to the position 4'. The position 4' is shown by broken lines. From this pivoted position, the ammunition unit is longitudinally displaceable in the direction 9 into a carrier unit **8*a*** in the turntable.

In FIG. 2, the position illustrated in FIG. 1 for the carrier unit **8*a* is indicated by reference numeral 8*a*. The turntable pivots about a pivotal centre 9. In FIG. 2, the carrier unit has been pivoted from the position 8*a'* to the position 8*a''* shown by solid lines. This pivoting was effected in the direction of the arrow 10 (counterclockwise). The turntable is provided with a second carrier unit 8b which is disposed in parallel with the carrier unit 8a and is slightly longitudinally offset in relation thereto. In FIG. 2, the carrier unit 8b is shown only in a position which corresponds to the position 8a'' shown by solid lines for the carrier unit 8a. The carrier units 8a and 8b are located on either side of the pivotal centre 9. Of the carrier units 8a and 8b, it is only the unit 8a which is located in the feeding path for the relevant ammunition unit, while the carrier unit 8b** lies outside the feeding path.

According to FIG. 3, the position 8a'' assumed by the turntable corresponds to the current traverse position of the gun 11. In this traverse position, the ammunition unit 3 may be collected from the carrier unit 8a with the aid of transfer devices which, in the present case, comprise a loading pendulum 12 which, via its journal arm 13, is carried in the journal 14. According to FIG. 3, the turntable is disposed horizontally and the loading pendulum is obliquely inclined in relation to the carrier unit on the turntable. Consequently, the transfer devices may include lifting means (not shown in detail) which raise the round from the carrier unit on the turntable in the direction of the arrow 15. From this raised position, the ammunition unit may be transferred to the loading pendulum 12 in the direction of the arrow 16. The loading pendulum is pivoted upwardly to a position in an extension of the bore axis, in the direction of the arrow 17. This upwardly pivoted position is shown by broken lines for the ammunition unit 3. From the upwardly pivoted position, the ammunition unit is moved to the ramming position in the gun 11 in the direction of the arrow 18.

The above-described feeding path for the ammunition unit 3 is equivalent for the ammunition unit 3'. The inward pivoting of the cradle 4, the driving of the turntable, and the functions in the transfer devices may be executed in manners. Infeed and discharge of each respective ammunition unit in each respective carrier unit may likewise be effected in a known manners.

FIG. 4 illustrates the case in which the carrier unit 8a and 8b are alternatingly inwardly pivotal into the feeding path by imparting to the turntable a movement through 180°. It will be appreciated from FIG. 4 that, by such a movement, the carrier unit 8b will be inwardly pivoted into the position of the carrier unit 8a, in other words will be inwardly pivoted into the feeding path in which the carrier unit is assumed to be in accordance with the above description. In conjunction with the inward pivoting of the carrier unit 8b into the feeding path, the carrier unit 8a is correspondingly pivoted out of the path where it, in a correspondingly manner, will passively follow the operation of the carrier unit 8b in the feeding path. The carrier unit 8b is further assumed to be loaded with one ammunition unit 3b when it is pivoted into the feeding path. The ammunition unit 3a fed to the turntable is correspondingly moved out of the feeding path. By allocating to the carrier unit 8a a first ammunition type 3a and to the carrier unit 8b a second ammunition type 3b, it will be appreciated that switching of ammunition unit types in the feeding path may be effected in a simple manner in the turntable. Hence, the ammunition unit fed to the turntable need not be advanced further into the feeding path and be fired from the gun before switching of ammunition type can take place. Discharge from the magazines of different ammunition types may be effected in a known manner.

FIG. 5 shows how transverse feeding movements for ammunition units 3, 3' may be effected in the transverse directions according to the arrows 19 and 20 respectively to the discharge positions of the magazines (not shown in detail).

The present invention should not be considered as restricted to the embodiment described above and shown on the Drawings by way of example, many modifications being conceivable without departing from the spirit and scope of the appended Claims and inventive concept as herein disclosed.

What I claim and desire to secure by letters patent is:

1. An ammunition feeding system, comprising:

at least a first and second magazine for a first and second type of ammunition unit;

two movable members, one of said members designated for each respective magazine, said members being alternatingly swingable between an outlet position of said respective magazine and a common feeding position;

a turntable which is turnable around an axis between a first and a second position, said turntable including a first and a second carrier unit positioned substantially in parallel with each other and on opposite sides of a center line extending in a horizontal plane of said turntable, said carrier units being mutually displaceable between feeding and idle positions;

said first carrier unit, in a first turned position of said turntable, being in said feeding position with its longitudinal axis coinciding with a feeding direction of said first type ammunition unit, said second carrier unit being in an idle position, said first type of ammunition being fed, in a horizontal position, onto said first carrier unit from said first movable member which is in said common feeding position; and said second carrier unit, in a second turned position of said turntable which is at 180° from said first turned position in said horizontal plane, being in said feeding position with its longitudinal axis coinciding with a feeding direction of said second type ammunition unit, said second type ammunition unit being fed, in a horizontal position, onto said second carrier unit from said second movable member, which is in said common feeding position.

2. An ammunition feeding system according to claim 1, wherein said movable members are swingable cradles.

3. An ammunition feeding system according to claim 2, wherein each respective ammunition unit is transferable nose-first to said carrier unit being in said feeding position.

4. An ammunition feeding system according to claim 2, wherein the ammunition unit stored in said second carrier unit has its nose pointing in the opposite direction to the ammunition unit in said first carrier unit.

5. An ammunition feeding system according to claim 1, wherein said first and second carrier units are longitudinally offset with respect to each other.

6. An ammunition feeding system according to claim 1, wherein each respective ammunition unit is transferable nose-first to said carrier unit being in said feeding position.

7. An ammunition feeding system according to claim 1, wherein the ammunition unit stored in said second carrier unit has its nose pointing in the opposite direction to the ammunition unit in said first carrier unit.

8. An ammunition feeding system according to claim 1, wherein switching of said carrier units between said feeding and idle positions is effectuable by rotating said turntable through 180° in its plane of rotation.

9. An ammunition feeding system according to claim 1, further comprising transferring means for moving said ammunition unit from the respective carrier unit being in said feeding position and transferring said ammunition unit to a ramming position in the gun.

* * * * *